US007730956B2

(12) United States Patent
Smithson

(10) Patent No.: US 7,730,956 B2
(45) Date of Patent: Jun. 8, 2010

(54) DOWNHOLE PRESSURE BALANCED ELECTRICAL CONNECTIONS

(75) Inventor: Mitchell C. Smithson, Pasadena, TX (US)

(73) Assignee: Welldynamics, Inc., Spring, TX (US)

( * ) Notice: Subject to any disclaimer, the term of this patent is extended or adjusted under 35 U.S.C. 154(b) by 285 days.

(21) Appl. No.: 11/751,696

(22) Filed: May 22, 2007

(65) Prior Publication Data

US 2007/0284117 A1 Dec. 13, 2007

(30) Foreign Application Priority Data

Jun. 12, 2006 (WO) ..... PCT/US2006/022731

(51) Int. Cl.
*E21B 43/00* (2006.01)

(52) U.S. Cl. ..... 166/385; 166/65.1

(58) Field of Classification Search ..... 166/385, 166/65.1, 242.4, 250.01
See application file for complete search history.

(56) References Cited

U.S. PATENT DOCUMENTS 4,624,306 A * 11/1986 Traver et al. ..... 166/53
4,799,546 A * 1/1989 Hensley et al. ..... 166/254.2
5,058,683 A * 10/1991 Godfrey et al. ..... 166/381
5,353,877 A * 10/1994 DeCorps et al. ..... 166/385
5,769,160 A 6/1998 Owens
5,927,402 A * 7/1999 Benson et al. ..... 166/65.1
6,484,801 B2 * 11/2002 Brewer et al. ..... 166/65.1
2002/0124640 A1 * 9/2002 Brewer ..... 73/152.49

OTHER PUBLICATIONS

International Preliminary Report on Patentability issued Dec. 31, 2008, for International Patent Application Serial No. PCT/US06/22731, 5 pages.

* cited by examiner

*Primary Examiner*—Hoang Dang
(74) *Attorney, Agent, or Firm*—Marlin R. Smith

(57) ABSTRACT

Pressure balanced downhole connections. A well system includes a well tool, a conduit assembly connected to the well tool, the conduit assembly including a conduit and a line positioned within the conduit, the line being connected to the well tool for operation of the well tool, and a device for equalizing pressure between an interior and an exterior of the conduit, the device being positioned downhole. A method of isolating a line in a subterranean well from well fluids in the well includes the steps of: connecting a conduit assembly to a device for equalizing pressure between an interior and an exterior of the conduit assembly, the conduit assembly including a line installed within a conduit; and positioning the conduit assembly and pressure equalizing device in the well.

17 Claims, 8 Drawing Sheets

DOWNHOLE PRESSURE BALANCED ELECTRICAL CONNECTIONS

CROSS-REFERENCE TO RELATED APPLICATION

The present application claims the benefit under 35 USC §119 of the filing date of International Application No. PCT/US2006/022731, filed Jun. 12, 2006. The entire disclosure of this prior application is incorporated herein by this reference.

BACKGROUND

The present invention relates generally to operations performed and equipment utilized in conjunction with a subterranean well and, in an embodiment described herein, more particularly provides downhole pressure balanced electrical connections.

It is known to enclose lines, such as electrical and optical lines, in pressure-bearing conduits to protect the lines from well fluids in a subterranean well. Typically, the conduits isolate the lines not only from the damaging, corrosive and/or electrically conductive fluids, but also from the pressure exerted by the fluids in the well. The pressure might be hydrostatic and/or applied pressure.

Unfortunately, the need to isolate the lines from pressure leads to several problems in making connections in the lines downhole. For example, pressure-bearing connectors must be used at each connection, and each connector must be capable of reliably withstanding the entire hydrostatic and applied pressure in the well.

Another problem is that the conduit itself must be designed to withstand the entire hydrostatic and applied pressure. Thus, relatively expensive materials and highly reliable designs must be used for the conduit and connectors.

A system has previously been available in which the conduit is filled with dielectric fluid. The dielectric fluid is pressurized from the surface via a pump. However, this system requires that the pressure be transmitted all the way from the surface, which may in some cases be thousands of meters from a downhole tool to which the lines are connected.

Therefore, it may be seen that improvements are needed in the art of protecting and insulating lines in subterranean wells.

SUMMARY

In carrying out the principles of the present invention, a system is provided which solves at least one problem in the art. One example is described below in which a downhole pressure equalizing device is used to pressurize fluid in a conduit assembly. Another example is described below in which a pressure transmitting device transmits pressure between an interior and exterior of the conduit assembly downhole.

In one aspect of the invention, a well system is provided which includes a well tool and a conduit assembly connected to the well tool. The conduit assembly includes a conduit and a line positioned within the conduit. The line is connected to the well tool for operation of the well tool. A downhole device equalizes pressure between an interior and an exterior of the conduit.

In another aspect of the invention, a method of isolating a line in a subterranean well from well fluids in the well includes the steps of: connecting a conduit assembly to a device for equalizing pressure between an interior and an exterior of the conduit assembly, the conduit assembly including a line installed within a conduit; and positioning the conduit assembly and pressure equalizing device in the well.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
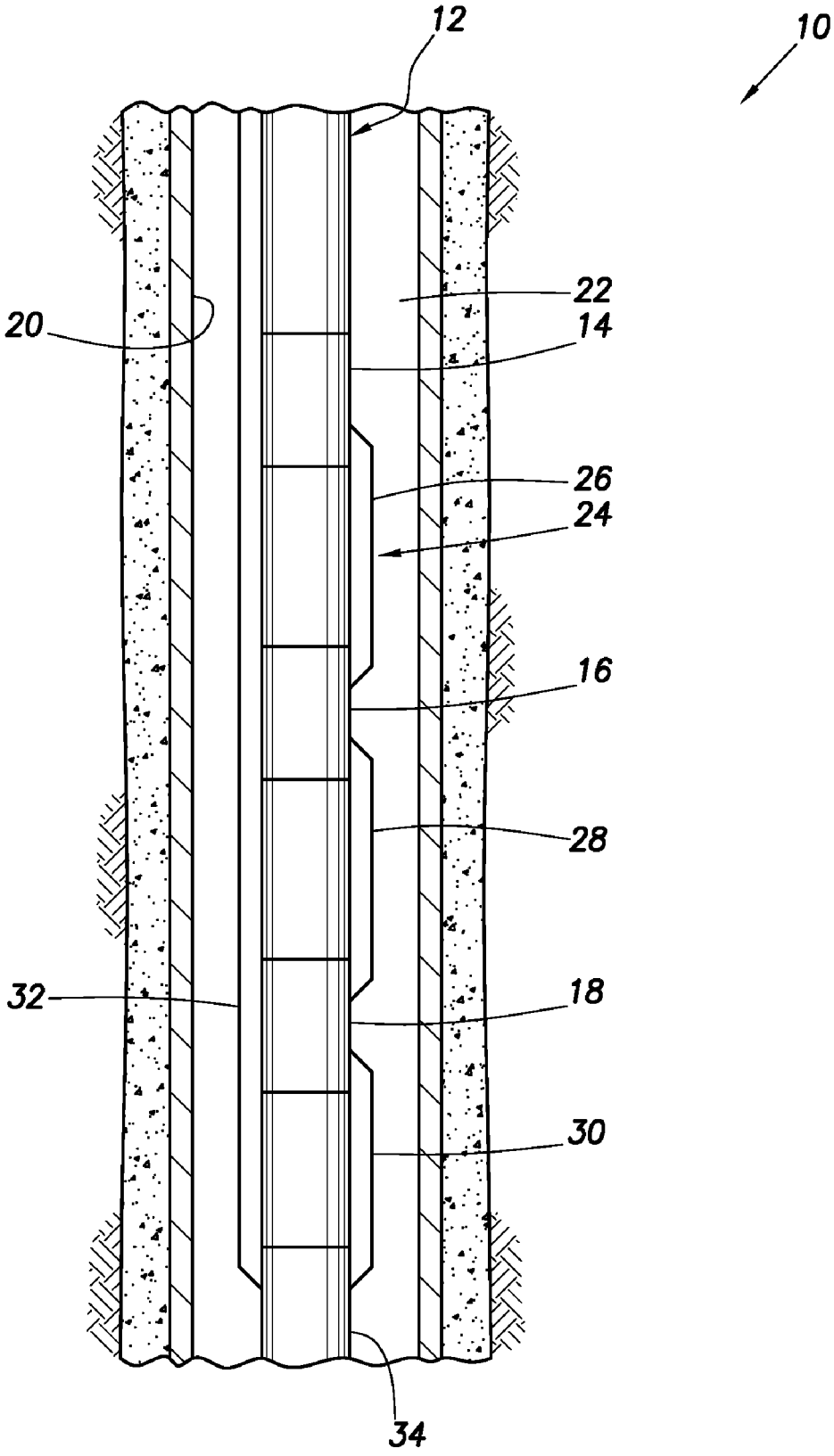
FIG. 1 is a schematic partially cross-sectional view of a well system embodying principles of the present invention.

Representatively illustrated in FIG. 1 is a well system 10 which embodies principles of the present invention. As depicted in FIG. 1, the well system 10 includes a tubular string 12 (such as a production tubing string) in which several well tools 14, 16, 18 are interconnected. The well tools 14, 16, 18 may be any type of well equipment, such as valves, chokes, any other type of flow control devices, packers, hangers, any other type of anchoring and/or sealing devices, etc.

The tubular string 12 is installed in a wellbore 20, thereby forming an annulus 22 between the tubular string and the wellbore. Although the wellbore 20 is illustrated in FIG. 1 as being cased and cemented, it should be understood that the wellbore could instead be uncased or open hole, in which case the annulus 22 would be formed between the tubular string 12 and an earth formation through which the wellbore is drilled.

In addition, it should be understood that the details of the well system 10 are described herein only so that persons skilled in the art will understand how the invention is made and used. The invention could also be practiced in a wide variety of other well systems which share none, or only a few, of the details of the well system 10.

A conduit assembly 24 is connected to the well tools 14, 16, 18. The conduit assembly 24 includes a conduit section 26 for connecting between the well tools 14, 16, a conduit section 28 for connecting between the well tools 16, 18, and a conduit section 30 for connecting between the well tool 18 and a pressure equalizing device 34. Another conduit section 32 connects between the pressure equalizing device 34 and the surface (which may be at a land-based or subsea well facility).

The pressure equalizing device 34 is located downhole and is used to equalize pressure between an interior and an exterior of the conduit assembly 24. Preferably, the pressure equalizing device 34 equalizes pressure between the interiors of the conduit sections 26, 28, 30 and the annulus 22 in the well system 10.

Note that any of the conduit sections 26, 28, 30, 32 may include one or more individual lengths of conduit. In addition, although the conduit sections 26, 28, 30, 32 are depicted in FIG. 1 as being externally attached to the tubular string 12 and to the well tools 14, 16, 18, any of the conduit sections could be internal to any of the well tools and tubular string if desired.

Furthermore, any number of conduit sections and well tools may be used. It is not necessary for any of the conduit sections or well tools to be interconnected in a tubular string. For example, they could instead be interconnected in a casing string, internal or external to the casing string, internal or external to a tubing or liner string, etc. The number, arrangement, attachments, etc. of the conduit sections and well tools in FIG. 1 are used merely for illustration purposes.

The conduit section 32 which extends to the surface is not necessarily pressure equalized using the device 34. Instead, the conduit section 32 may be constructed similar to that described in U.S Pat. No. 5,769,160, the entire disclosure of which is incorporated herein by this reference.

Figure 2:
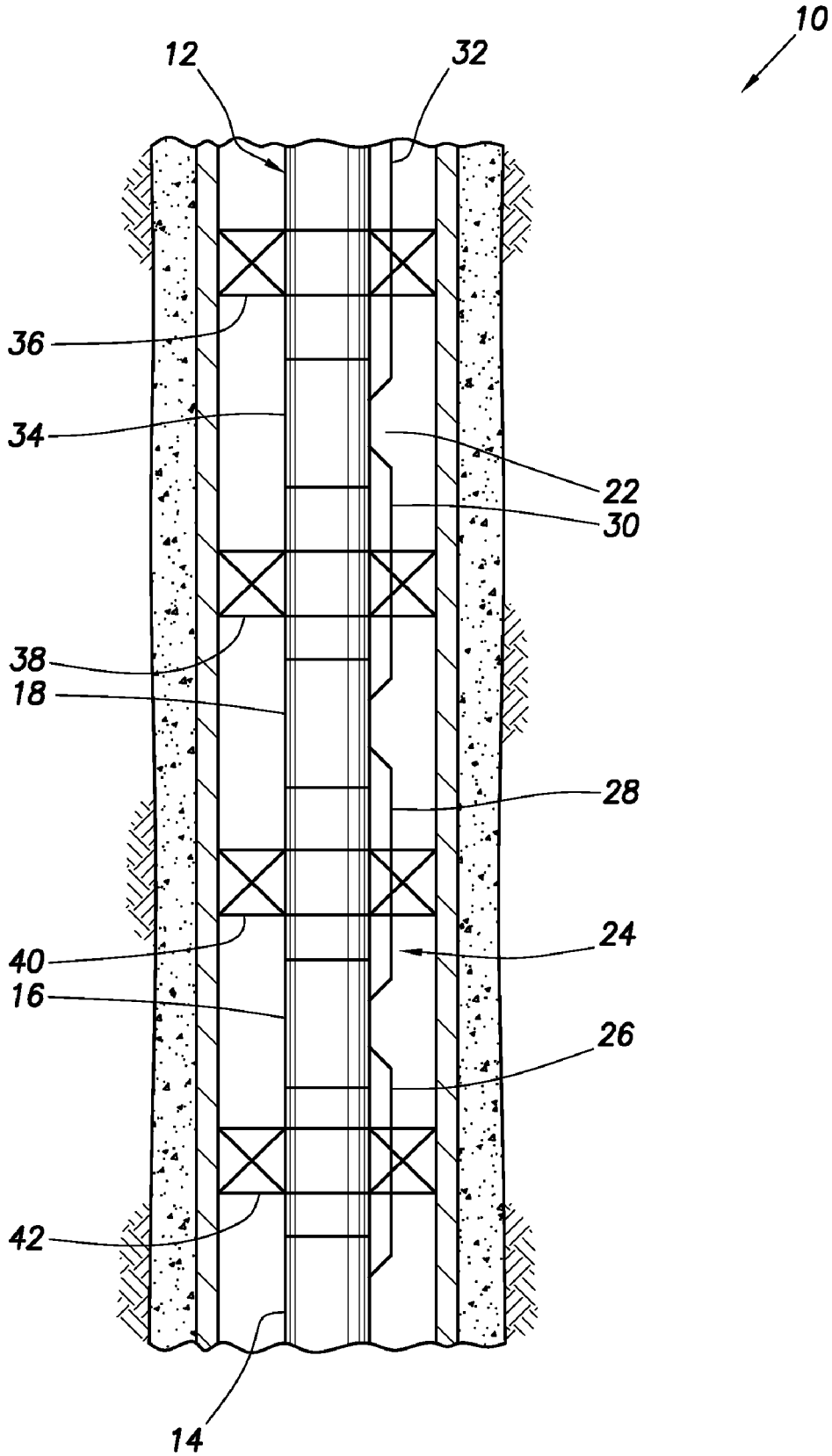
FIG. 2 is a schematic partially cross-sectional view of an alternate configuration of the well system of FIG. 1.

FIG. 2 representatively illustrates an example of another configuration of the well system 10 which still incorporates principles of the invention. In this configuration, the pressure equalizing device 34 is positioned above each of the well tools 14, 16, 18.

In addition, packers 36, 38, 40, 42 isolate the annulus 22 above the pressure equalizing device 34 and between each of the well tools 14, 16, 18. Each of the conduit sections 26, 28, 30, 32 extends through a respective one of the packers 36, 38, 40, 42.

In each of the configurations of FIGS. 1 & 2, connections are made between the conduit sections and the well tools 14, 16, 18. As described in further detail below, connections are also made between the well tools 14, 16, 18 and electrical, optical or other types of lines within the conduit sections 26, 28, 30, 32 for operation of the well tools.

This operation may include supplying electrical or optical power to the well tools 14, 16, 18, transmitting data to or from the well tools, transmitting command or control signals to or from the well tools, otherwise communicating with the well tools, etc. In addition, hydraulic pressure may be supplied to the well tools 14, 16, 18 to provide motive force for operating the well tools, as described more fully below.

Figure 3:
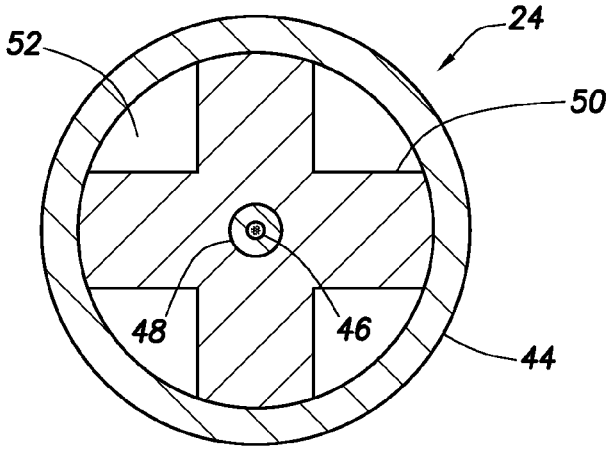
FIG. 3 is an enlarged scale schematic cross-sectional view of a conduit assembly which may be used in the well system.

Referring additionally now to FIG. 3, a cross-sectional view of the conduit assembly 24 is representatively illustrated. In this view it may be seen that the conduit assembly 24 includes a conduit 44 and a line 46 positioned within the conduit.

As discussed above, the line 46 may be an electrical line, optical line (such as an optical fiber), or another type of line. Any number and any combination of types of lines may be positioned in the conduit 44.

A sheath 48 preferably surrounds the line 46. If the line 46 is an electrical line, then the sheath 48 may be an electrical insulator, such as PTFE. If the line 46 is an optical line, then the sheath 48 may be a protective cover for the line.

A support structure 50 may be provided in the conduit 44. The support structure 50 may serve to support and/or center the line 46 within the conduit 44, internally support the conduit, prevent relative displacement or chafing between the line and the conduit, etc. The support structure 50 may be made of a material such as ETFE fluoropolymer, or another suitable material.

A fluid 52 fills the interior volume of the conduit 44 not occupied by the line 46, sheath 48 and support structure 50. If the line 46 is an electrical line, then the fluid 52 may be a dielectric fluid which will not corrode or otherwise damage the line, connectors, etc. If the line 46 is an optical line, then the fluid may be distilled water, or another fluid which will not cause damage to the line.

The conduit assembly 24 as depicted in FIG. 3 may be used for any or all of the conduit sections 26, 28, 30, 32 described above. In addition, other types of conduit assemblies may be used, such as any of those described in the incorporated U.S. Pat. No. 5,769,160.

As another example, the conduit assembly 24 could include merely the line 46 and sheath 48 within the conduit 44, with the fluid 52 occupying the interior of the conduit not occupied by the line and sheath. This configuration would be similar to that shown in FIG. 3, but without the support structure 50.

The conduit 44 could be formed by any method. For example, the conduit 44 could be a seamless extrusion, a folded and seam welded construction, etc.

Thus, any type of conduit assembly may be used in keeping with the principles of the invention, including any type of conduit, line, fluid, support structure, etc.

Figure 4:
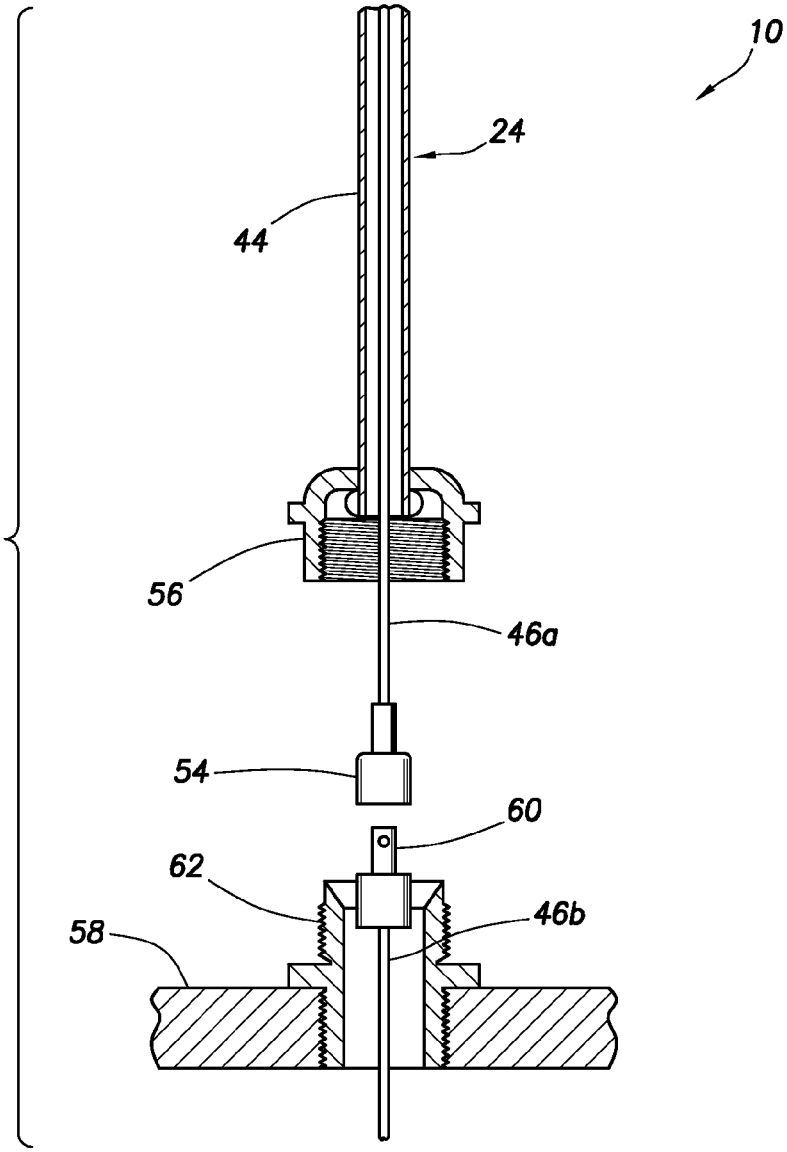
FIG. 4 is a schematic cross-sectional view of a method of making a connection between sections of a line in the well system.

Referring additionally now to FIG. 4, a method of making connections between lines 46*a*, 46*b* in the well system 10 is representatively illustrated. The lines 46*a*, 46*b* are separate lengths or sections of the line 46.

As depicted in FIG. 4, the conduit assembly 24 has at a lower end thereof an electrical connector 54 and a hydraulic connector 56. Of course, if the line 46 is an optical line or other type of line, then the connector 54 would be an optical connector or other appropriate type of connector.

The line 46*b* is illustrated in FIG. 4 as being associated with a bulkhead or housing 58, such as a housing of one of the well tools 14, 16, 18. An electrical connector 60 is at an upper end of the line 46*b*, and a hydraulic connector 62 is installed in the housing 58.

Alternatively, the hydraulic connector 62 could be associated with another section of conduit 44, so that the attached conduit sections may provide an extended length conduit assembly 24. As another alternative, the housing 58 could be a sidewall of a tubular string, so that the connectors 54, 56, 60, 62 provide a means for extending the line 46 between the interior and exterior of the tubular string. Thus, it should be appreciated that the connectors 54, 56, 60, 62 may be used to connect between any structures in keeping with the principles of the invention.

In operation, the connectors 54, 60 are connected, thereby electrically connecting the lines 46*a*, 46*b*. Then, the hydraulic connectors 56, 62 are connected, thereby pressure isolating the interior of the conduit assembly 24 from the external environment at the connection.

Although the connection between the hydraulic connectors 56, 62 is preferably capable of withstanding a substantial pressure differential between the interior and exterior of the conduit assembly 24, a beneficial feature of the well system 10 is that a large pressure differential is not experienced at the hydraulic connectors. In this manner, leaks at hydraulic connections in the conduit assembly 24 are substantially avoided.

Although the connectors 54, 56 are depicted in FIG. 4 as being separate elements, they could instead be combined into a single connector, and so could the connectors 60, 62. One example of an integrated hydraulic/electrical connector is the FMJ connector available from WellDynamics, Inc. of Spring, Tex. Furthermore, other types of connections (in addition to, or instead of, the illustrated hydraulic and electrical connections), and any combination of connections could be made, in keeping with the principles of the invention.

The conduit assembly 24 is illustrated in FIG. 4 without the support structure 50. This demonstrates that a wide variety of configurations of the conduit assembly 24 are possible without departing from the principles of the invention.

After the connectors 54, 56, 60, 62 are connected, the fluid 52 may be introduced into the conduit assembly 24. Methods of flowing the fluid 52 into the conduit assembly 24 are described more fully below.

Figure 5:
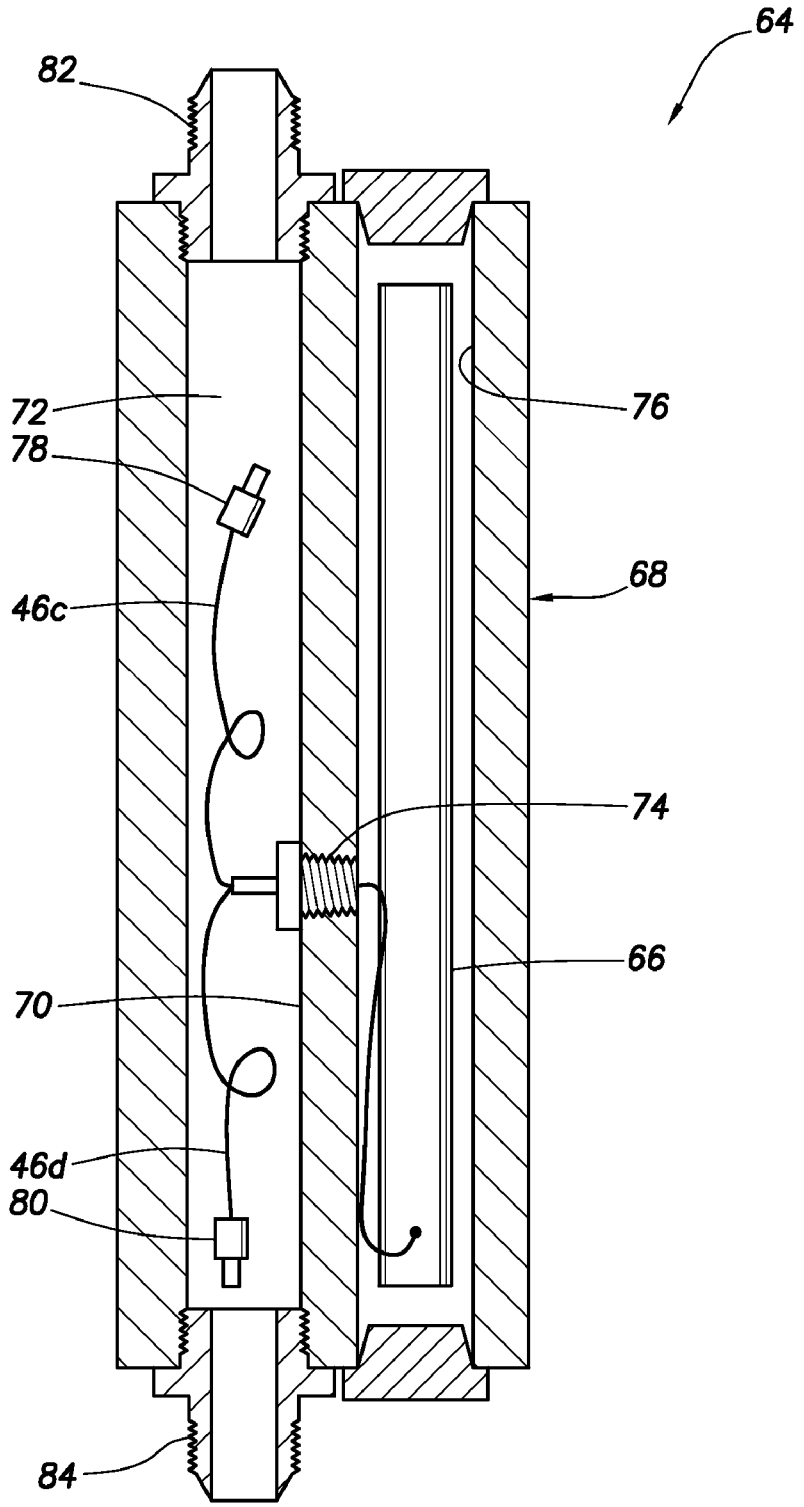
FIG. 5 is a schematic cross-sectional view of a well tool which may be used in the well system.

Referring additionally now to FIG. 5, a well tool 64 is representatively illustrated. The well tool 64 may be used for any of the well tools 14, 16, 18 in the well system 10. The well tool 64 is described herein as merely an example of a large number of different well tools which may be used in the well system 10 and other well systems, and which may benefit from the features of the invention.

The well tool 64 includes an electrical device 66 within an outer housing assembly 68. The electrical device 66 could be any type of electrical device which may be used in a well tool. For example, the electrical device 66 could be a sensor, actuator, transmitter, receiver, recorder, battery, generator, etc.

The housing assembly 68 includes a bulkhead 70 which separates the electrical device 66 from a passage 72. A conventional pressure-bearing electrical feed-through 74 provides for electrical conductivity between the device 66 and electrical lines 46*c*, 46*d* in the passage 72, while also providing pressure isolation between the passage and a chamber 76 in which the device 66 is contained, and electrically insulating between the housing assembly 68 and each of the lines 46*c*, 46*d* and the device 66.

The housing assembly 68 may be interconnected in the tubular string 12 using, for example, internally threaded end connections (not shown), or the well tool 64 could be positioned internal or external to the tubular string. The well tool 64 could be positioned, attached or connected in any manner in keeping with the principles of the invention.

Electrical connectors 78, 80 are provided at the ends of the lines 46*c*, 46*d*, and hydraulic connectors 82, 84 are provided at either end of the passage 72. The connectors 78, 80 may be similar to the connectors 54, 60 described above, and the connectors 82, 84 may be similar to the connectors 56, 62 described above. In addition, the connectors 78, 82 and the connectors 80, 84 may be integrated into a single connector, if desired.

In operation, the connectors 78, 80 are connected to corresponding electrical connectors on sections of the conduit assembly 24 (such as conduit sections 26, 28, 30, 32), and the connectors 82, 84 are connected to corresponding hydraulic connectors on the conduit sections. After the connectors 82, 84 are connected, the passage 72 and the conduit sections are filled with the fluid 52, as described more fully below. Note that the passage 72 provides for continuous fluid communication between the conduit sections attached on either side of the well tool 64.

Figure 6:
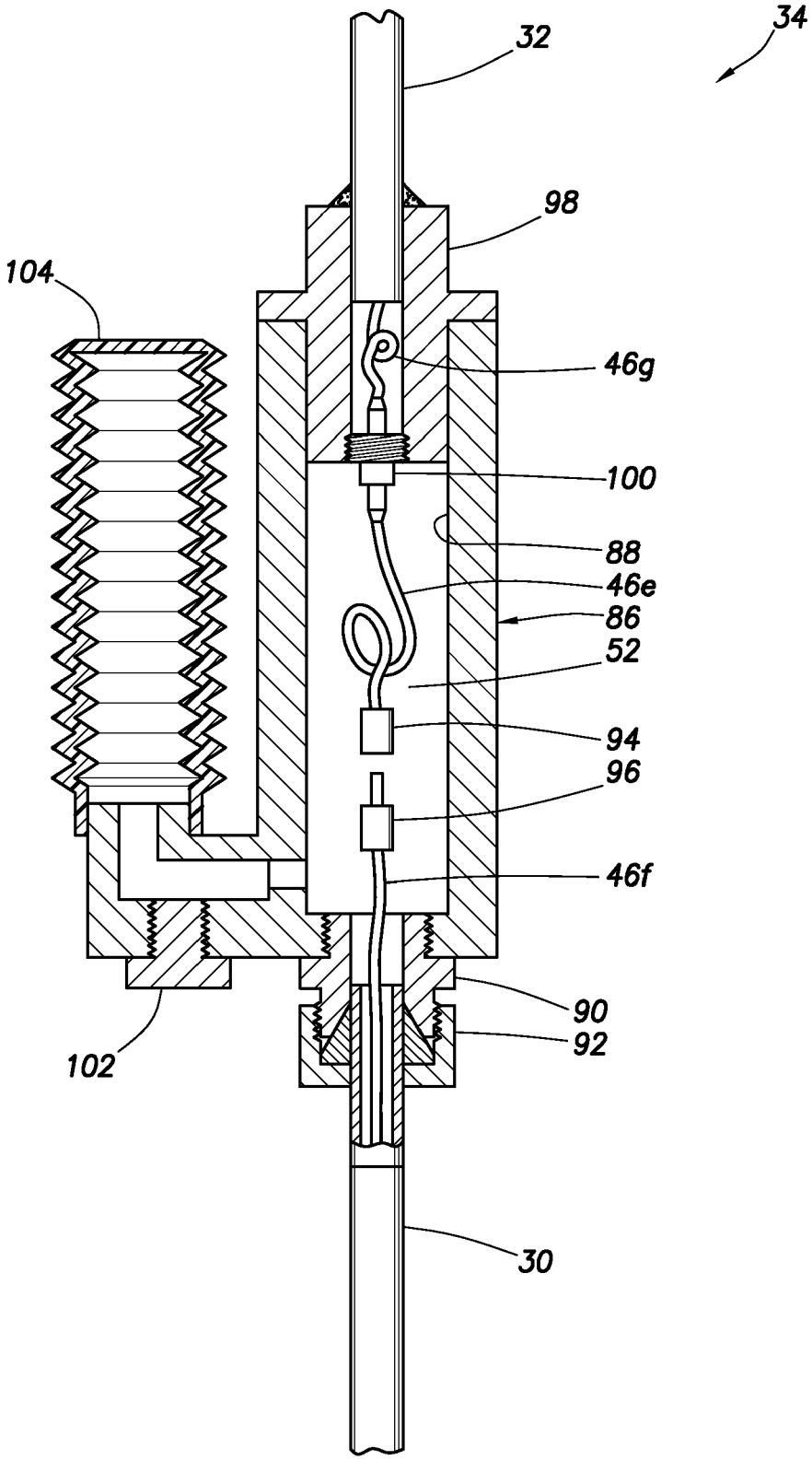
FIG. 6 is a schematic cross-sectional view of a device for equalizing pressure downhole.

Referring additionally now to FIG. 6, a cross-sectional view of the pressure equalizing device 34 is representatively illustrated. The equalizing device 34 is depicted as it might be used in the configuration of the well system 10 shown in FIG. 2, but other constructions are possible in keeping with the principles of the invention.

As illustrated in FIG. 6, the equalizing device 34 includes a housing assembly 86 with a chamber 88 therein. The housing assembly 86 is interconnected in the conduit assembly 24 with the conduit section 30 connected at a lower end, and the conduit section 32 connected at an upper end.

Hydraulic connectors 90, 92 are used to provide a pressure-bearing connection between the housing assembly 86 and the conduit section 30. Electrical connectors 94, 96 are used to provide electrical connection between sections 46*e*, 46*f* of the line 46. Although the connectors 94, 96 are depicted in FIG. 6 as being disconnected, these connectors would preferably be connected prior to connecting the hydraulic connectors 90, 92.

The conduit section 32 is attached to the housing assembly 86 via a bulkhead 98 which may be permanently sealed and joined to the housing assembly and conduit section, for example, by welding. Alternatively, the bulkhead 98 may be releasably connected to either or both of the conduit section 32 and housing assembly 86.

An electrical feed-through 100 (which may be similar to the feed-through 74 described above), is installed in the bulkhead 98. The feed-through 100 provides pressure isolation between the chamber 88 and the interior of the conduit section 32, provides electrical conductivity between the line section 46*e* and another line section 46*g* in the conduit section, and provides insulation between the bulkhead 98 and each of the line sections.

After the connectors 90, 92 and the connectors 94, 96 are connected, the chamber 88 and the interior of the conduit section 30 (and any other sections of the conduit assembly 24 which are in fluid communication with the conduit section 30) are filled with the fluid 52 via a fill port or fluid transfer device 102. Although the device 102 is depicted in FIG. 6 as including a plug threaded into the housing assembly 86, other types of fill ports may be used.

The device 102 may, for example, include a check valve (such as a Schrader valve) for convenient opening of the fill port, and for preventing escape of the fluid 52 from the equalizing device 34. Any manner of filling the conduit assembly 24 and the equalizing device 34 with the fluid 52 may be used in keeping with the principles of the invention.

The equalizing device 34 further includes a pressure transmitting device 104 which is used to transmit pressure between the interior and exterior of the equalizing device and the conduit assembly 24. As depicted in FIG. 6, the transmitting device 104 is in the form of a bellows which operates to equalize pressure between the interior and exterior of the equalizing device 34.

However, it should be clearly understood that any other types of pressure transmitting devices could be used in place of the device 104 shown in FIG. 6. For example, a diaphragm or floating piston, etc. could be used to transmit pressure between the interior and exterior of the equalizing device 34, and between the interior and exterior of the conduit assembly 24.

Note that, by using the equalizing device 34 to equalize pressure between the interior and exterior of the conduit assembly 24, the hydraulic connectors 90, 92 (as well as connectors 56, 62, 82, 84) do not have to withstand a large pressure differential downhole. This greatly diminishes the possibility that the fluid 52 will leak out of the conduit assembly 24, or that well fluid will invade the interior of the conduit assembly. Thus, the line 46 (and its various sections 46*a*, 46*b*, 46*c*, 46*d*, 46*e*, 46*f*, etc., and connectors 54, 60, 78, 80, 94, 96) is protected from the potentially damaging and/or electrically conductive well fluid.

In addition, note that the pressure equalizing device 34 equalizes pressure between the interior and exterior of the conduit assembly 24 automatically as it is installed in the well. There is no need to calibrate the density of the fluid 52 in the interior of the conduit assembly 24 so that its hydrostatic pressure matches the pressure downhole in the well, and there is no need to pressurize the conduit assembly from a remote location (which is particularly difficult when the remote location is thousands of meters distant and the pressure must be transmitted via small capillary passages in the conduit assembly, resulting in a substantial pressure drop and time lag between application of pressure and transmission of the pressure to the downhole end of the conduit assembly). The pressure equalizing device 34 is capable of equalizing pressure between the interior and exterior of the conduit assembly 24 regardless what densities of fluids are on the interior and exterior of the conduit assembly.

Although the pressure equalizing device 34 is depicted in FIG. 6 as being used to provide a connection between the conduit sections 30, 32, it should be understood that the pressure equalizing device could be located in any position and could provide a connection between any of the conduit sections 26, 28, 30, 32 in keeping with the principles of the invention. For example, the pressure equalizing device 34 could be used to provide a connection between the conduit sections 28, 30 (in which case the equalizing device could be incorporated into the well tool 18).

Furthermore, it is not necessary for the pressure equalizing device 34 to provide a connection between conduit sections. Instead, the equalizing device 34 could be positioned at the downhole end of the conduit assembly 24 (for example, connected at the end of the conduit section 26 and/or incorporated into the well tool 14). In that case, the equalizing device 34 may also not provide for a connection between sections of the line 46.

Figure 7:
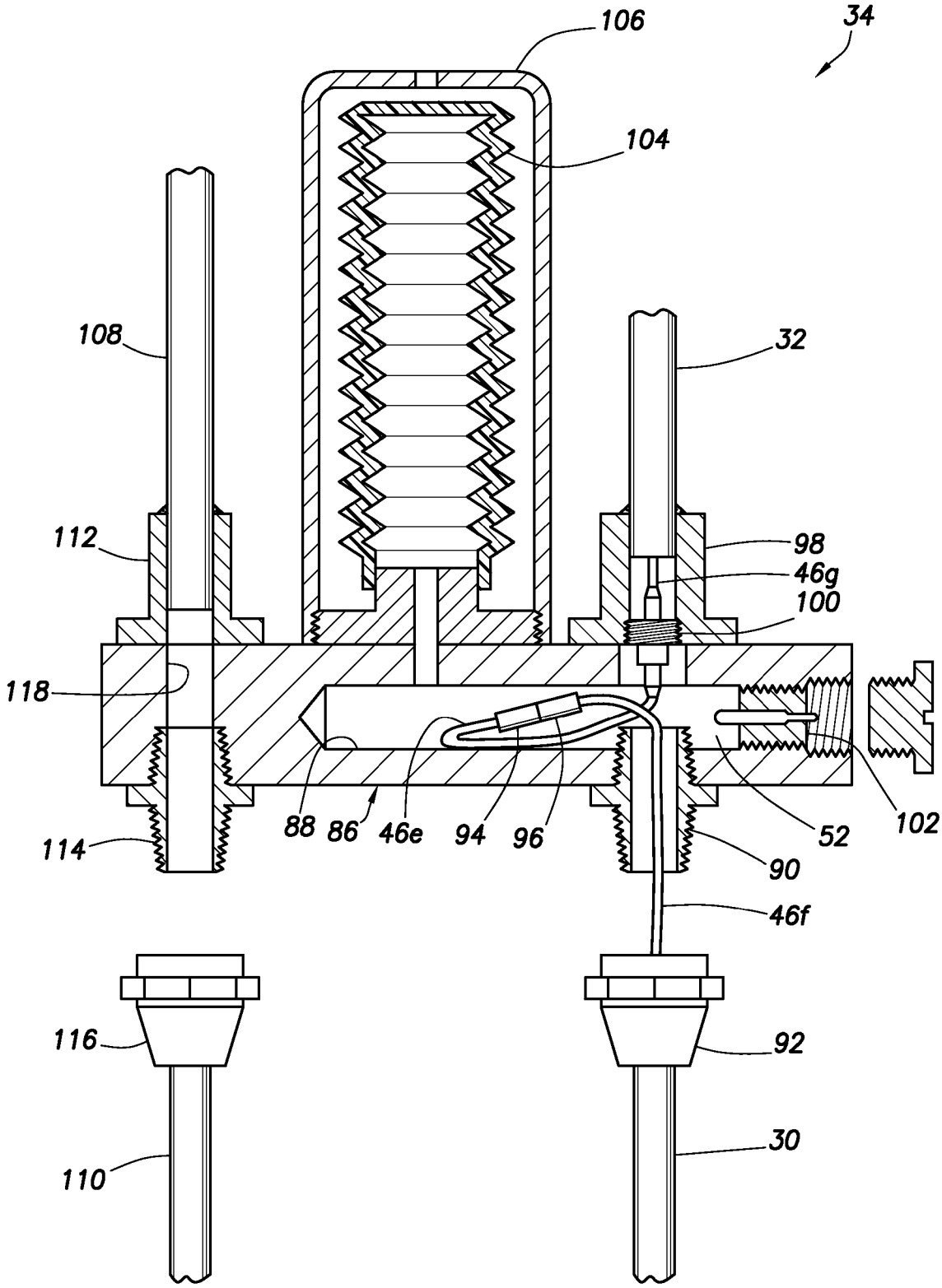
FIG. 7 is a schematic cross-sectional view of a first alternate configuration of the device for equalizing pressure downhole.

Referring additionally now to FIG. 7, the pressure equalizing device 34 is representatively illustrated in a somewhat different configuration. However, the same reference numbers have been used for similar elements depicted in FIG. 6, for convenience and clarity of description.

In this view, the chamber 88 extends horizontally, instead of vertically as in FIG. 6. The fluid transfer device 102 is depicted as including a Schrader valve. A protective cover 106 is provided for the pressure transmitting device 104.

Another significant difference is that the housing assembly 86 provides for connection of separate hydraulic conduit sections 108, 110 via a respective bulkhead 112 and hydraulic connectors 114, 116. A passage 118 in the housing assembly 86 provides for fluid communication between the conduit sections 108, 110.

The conduit sections 108, 110 may be elements of a separate hydraulic circuit. For example, the hydraulic circuit may be used to send command and control signals to a downhole control module (such as the Sensor Actuator Module available from WellDynamics, Inc. of Spring, Tex.) for controlling operation of any of the well tools 14, 16, 18. The hydraulic circuit may also be used to provide hydraulic pressure to generate motive force to actuate a well tool.

The pressure equalizing device 34 as depicted in FIG. 7 allows the conduit section 30 to be connected to the conduit section 32, while also conveniently providing for connection of the conduit sections 108, 110 in a single assembly. Thus, it will be appreciated that many different configurations of the pressure equalizing device 34 are possible in keeping with the principles of the invention.

Figure 8:
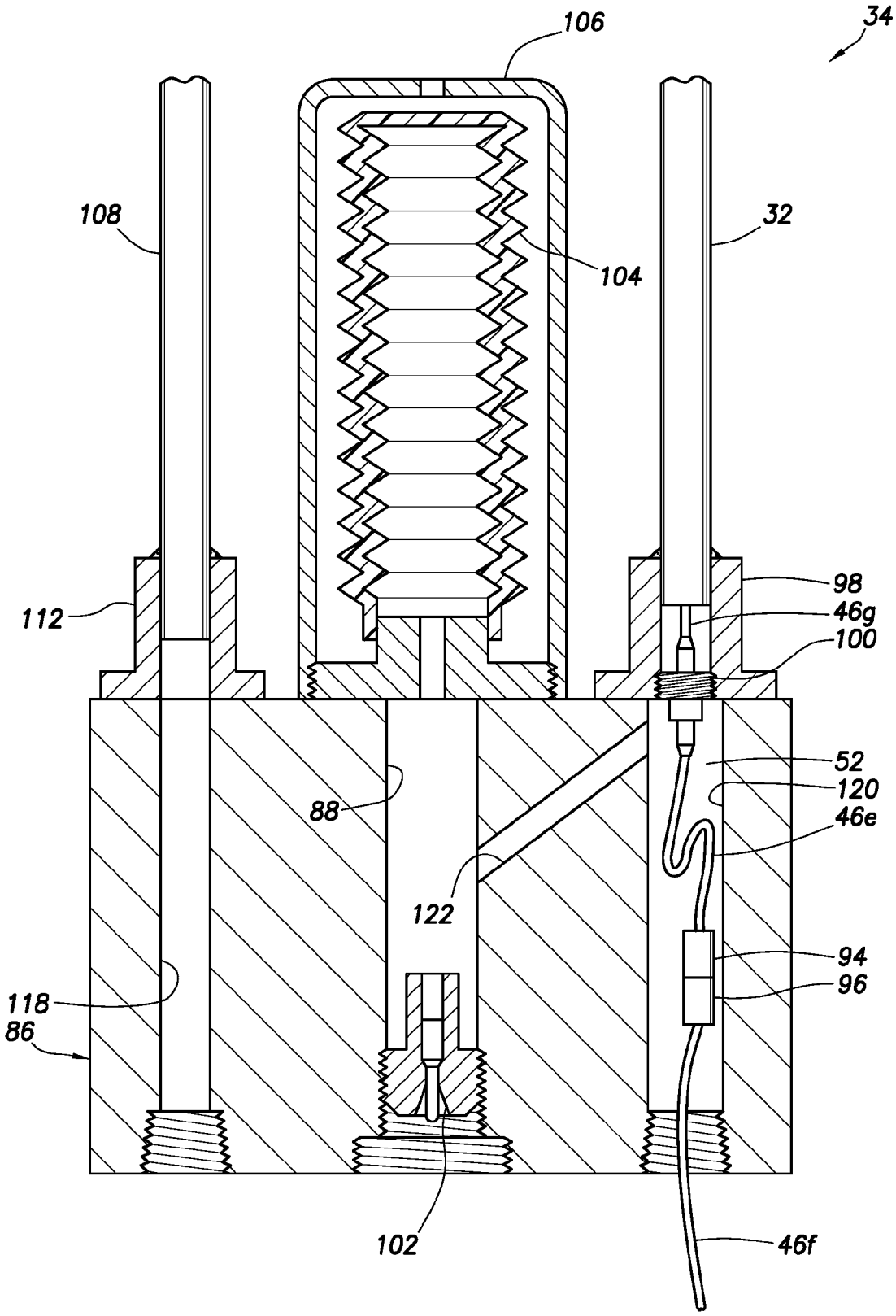
FIG. 8 is a schematic cross-sectional view of a second alternate configuration of the device for equalizing pressure downhole.
Figure 9:
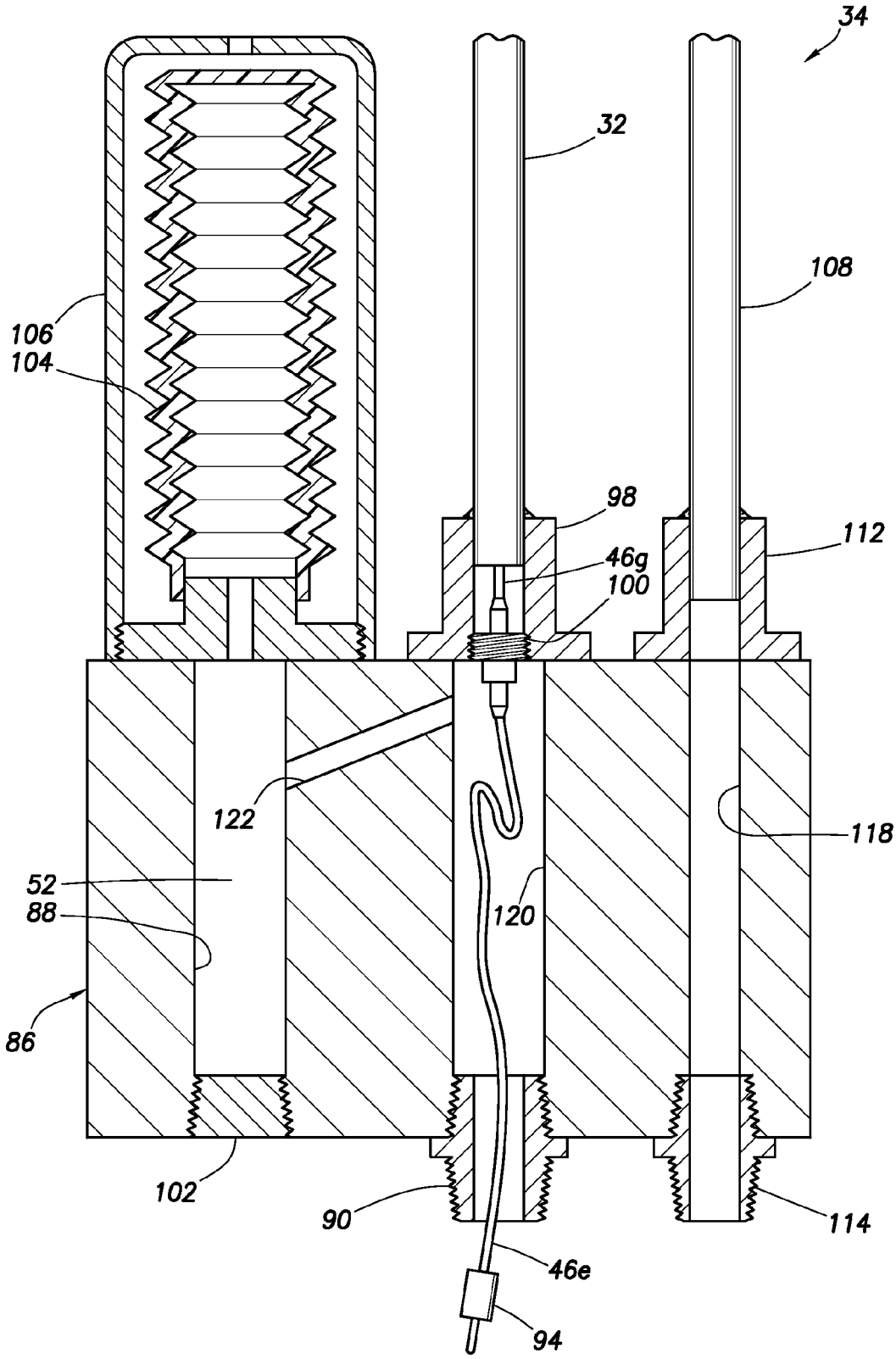
FIG. 9 is a schematic cross-sectional view of a third alternate configuration of the device for equalizing pressure downhole.

Referring additionally now to FIGS. 8 & 9, additional alternate configurations of the pressure equalizing device 34 are representatively illustrated. In FIG. 8, the chamber 88 is separately formed from a chamber 120 in which the connectors 94, 96 are connected, but a passage 122 provides for fluid communication between the chambers 88, 120. In FIG. 9, the elements are differently arranged, but the configuration is functionally similar to the FIG. 8 embodiment.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. For example, in each instance in which an electrical connector or connection is described above, an optical or other type of connector or connection could be used instead. Accordingly, the foregoing detailed description is to be clearly understood as being given by way of illustration and example only, the spirit and scope of the present invention being limited solely by the appended claims and their equivalents.

What is claimed is:

1. A well system, comprising:

a first well tool connected to a first line which operates the first well tool;

a second well tool connected to a second line which operates the second well tool;

a conduit assembly interconnecting the first and second well tools, the conduit assembly including a conduit, and at least one of the first and second lines being positioned within the conduit; and a device which equalizes pressure between an interior and an exterior of the conduit assembly, the device being positioned downhole.

2. The system of claim 1, wherein the first and second lines comprise at least one of an electrical and an optical line.

3. The system of claim 1, wherein the pressure equalizing device is capable of equalizing pressure between the interior and exterior of the conduit assembly regardless what densities of fluids are on the interior and exterior of the conduit assembly.

4. The system of claim 1, wherein the pressure equalizing device includes a device for transmitting pressure between the interior and exterior of the conduit assembly.

5. The system of claim 4, wherein the pressure transmitting device comprises a bellows.

6. The system of claim 1, wherein the pressure equalizing device includes a housing assembly, the conduit assembly being releasably connected to the housing assembly via a fluid-tight connector, and further comprising a fluid transfer device for flowing fluid through the conduit assembly and housing assembly.

7. The system of claim 6, further comprising a device for transmitting pressure between an interior and an exterior of the housing assembly.

8. The system of claim 7, wherein the pressure transmitting device comprises a bellows.

9. A method of isolating a line in a subterranean well from well fluids in the well, the method comprising the steps of:

interconnecting via a conduit assembly a first well tool and a second well tool operated by respective first and second lines, the conduit assembly including at least one of the first and second lines installed within a conduit;

connecting the conduit assembly to a device which equalizes pressure between an interior and an exterior of the conduit assembly; and positioning the conduit assembly and the pressure equalizing device in the well.

10. The method of claim 9, wherein the pressure equalizing device includes a device for transmitting pressure between the interior and exterior of the conduit assembly, and wherein the positioning step further comprises positioning the pressure transmitting device in the well.

11. The method of claim 9, wherein in the interconnecting step, the first and second lines comprise at least one of an electrical and an optical line.

12. The method of claim 9, wherein the connecting step further comprises connecting the conduit assembly to a housing assembly with a releasable connector.

13. The method of claim 12, wherein the connecting step further comprises using a fluid transfer device to flow fluid through the housing assembly and the conduit assembly.

14. The method of claim 12, further comprising the step of making an electrical connection in the housing assembly.

15. The method of claim 12, further comprising the step of making an optical connection in the housing assembly.

16. The method of claim 9, further comprising the step of connecting the first and second lines to the respective first and second well tools.

17. The method of claim 16, further comprising the step of operating at least one of the first and second well tools via at least one of the respective first and second lines.

* * * * *